United States Patent [19]

Gerber

[11] Patent Number: 4,581,965

[45] Date of Patent: Apr. 15, 1986

[54] APPARATUS AND RELATED METHOD FOR CUTTING AND DEDUSTING SHEET MATERIAL

[75] Inventor: Heinz J. Gerber, West Hartford, Conn.

[73] Assignee: Gerber Scientific, Inc., South Windsor, Conn.

[21] Appl. No.: 735,474

[22] Filed: May 17, 1985

[51] Int. Cl.[4] ..... B26D 7/18

[52] U.S. Cl. ..... 83/24; 83/56; 83/168; 83/422; 83/925 CC; 15/1.5 R

[58] Field of Search ..... 83/24, 56, 168, 169, 83/925 CC, 422; 15/1.5 R, 1.5 A

[56] References Cited

U.S. PATENT DOCUMENTS

| | | | |
|---|---|---|---|
| 2,582,939 | 1/1952 | Frederick | 15/1.5 R X |
| 3,045,273 | 7/1962 | Bruno | 15/1.5 R X |
| 3,142,856 | 8/1964 | Maguire, Jr. | 83/168 X |
| 3,420,004 | 1/1969 | O'Brien | 15/1.5 R X |
| 3,421,216 | 1/1969 | Anna | 15/1.5 R X |
| 4,281,431 | 8/1981 | Nierlich et al. | 15/1.5 R |
| 4,333,369 | 6/1982 | McCort | 83/168 X |
| 4,345,496 | 8/1982 | Pearl | 83/168 X |

*Primary Examiner*—Frank T. Yost

*Attorney, Agent, or Firm*—McCormick, Paulding & Huber

[57] ABSTRACT

An automatic cutting and dedusting apparatus for piled or fleecy worksheets comprises an automatic cutting apparatus, a means for applying an electric field to the worksheets to statically charge them, and a dedusting machine including means for agitating and moving air adjacent cut pattern pieces to remove pile fiber portions which were previously cut and thereby disconnected from said worksheets.

25 Claims, 8 Drawing Figures

APPARATUS AND RELATED METHOD FOR CUTTING AND DEDUSTING SHEET MATERIAL

BACKGROUND OF THE INVENTION

The invention relates generally to apparatuses and methods for cutting sheet material and deals more particularly with an apparatus and related method for cutting and dedusting piled or fleecy material, such as velour.

Automatic cutting apparatuses and methods are widely used today in the garment, automobile and furniture industries where much fabric is cut. Many of the cutting apparatuses are numerically controlled and are capable of cutting large quantities of pattern pieces from layups of sheet material with high speed and accuracy. For example, numerically controlled cutting apparatuses are shown in U.S. Pat. Nos. 3,955,458 issued Sept. 17, 1973; 3,830,122 issued Aug. 20, 1974; and 4,091,701 issued May 30, 1978; each to Pearl and assigned to Gerber Garment Technology, Inc. of East Hartford, Conn. and hereby incorporated by reference as part of the present disclosure. Such numerically-controlled apparatuses may include a vertically-mounted reciprocating cutting blade, a horizontal bed for supporting the layup and a computer programmed to direct the cutting blade to cut the layup along a desired path to form the pattern pieces.

To insure cutting accuracy, it is often advantageous to positively affix the layup to the support bed while the layup is being cut and, if possible, compress the layup as disclosed in U.S. Pat. Nos. 3,495,492 issued Feb. 17, 1970; 3,790,154 issued Feb. 5, 1975; and 3,765,289 issued Oct. 16, 1973; each to Gerber et al and assigned to Gerber Garment Technology, Inc., and hereby incorporated by references as part of the present disclosure. As further disclosed in these patents, the layup may be covered with a substantially air-impermeable sheet, and a vacuum may be applied to the underside of the air-impermeable sheet to draw the impermeable sheet toward the support bed to fix and compress the layup while it is being cut.

As an alternative to the vacuum holddown system described above, U.S. Pat. Nos. 2,897,424 and 2,897,425 to Waring disclose an electrostatic holddown system for a cutting apparatus.

Problems have emerged in the cutting of layups of piled or fleecy material, such as velour or velvet made of a carrier sheet and pile fibers attached at one end to the carrier sheet, especially when the layups are compressed during cutting and the pile fibers have a significant length, such as one-thirty-second to one-eighth of an inch or more. During such compression, each work sheet is flattened under the pressure exerted by the sheet above and the free ends of the pile fibers are generally bent downwardly towards the carrier sheet. Consequently, many of the pile fibers invariably cross the path of the cutting blade as the layup is cut and portions of such pile fibers are cut off and disconnected from the remainder of the worksheet. When the cutting operation is complete, the bundles of pattern pieces are usually transported to a subsequent work site and during this transportation many of the disconnected fiber portions may fall loose or otherwise escape from the bundles into the work environment as dust. This dust is unsightly, may lodge in machinery, litter the floor and is generally objectionable in other ways.

In other types of cutting apparatuses layups of piled or fleecy sheets may be cut without a holddown or compression system. In such an arrangement, many of the pile fibers are cut but the number cut is usually fewer than the number cut by a cutting apparatus using holddown and compression, because the pile fibers in a non-holddown system are bent less during the cutting process than in the vacuum holddown system described above and therefore fewer pile fibers cross the path of the cutting blade. Also, if dies are used to cut a layup of piled or fleecy sheet material, pile fibers crossing the line of cut may be cut to create pile dust. Even if a single sheet of such material is cut by a reciprocating knife or die without a holddown system some pile fibers are cut although usually much fewer than are cut from a sheet in a layup of such material cut under compression.

The pile fibers and/or carrier sheets of piled or fleecy work sheets, such as velours, are often made of polyester or other thermoplastic material, as for example in the case where the pattern pieces are to be used for making automobile seats or other objects requiring highly-durable and washable coverings. However, for these and other applications, the fleecy worksheets may also be made of nonplastic materials such as cotton, wool or leather, or a combination of such materials.

Accordingly, a general aim of the invention is to provide an apparatus and method for cutting and dedusting plastic and nonplastic piled material, such as velour, which apparatus and method minimize the number of disconnected fibers which fall or otherwise escape from pattern pieces into the work environment as dust during or subsequent to the cutting operation.

Another object of the invention is to provide dedusting means for the foregoing apparatus which dedusting means does not appreciably interfere with an otherwise conventional cutting operation and which does not degrade the quality of the pattern pieces cut during the cutting operation.

SUMMARY OF THE INVENTION

The present invention resides in an apparatus and method for efficiently cutting pattern pieces from piled or fleecy worksheets so that pile fibers which are cut and thereby disconnected from the worksheets do not escape from pattern pieces as dust particularly when the pattern pieces are transported from the cutting site. A cutting apparatus embodying the invention includes a cutting instrument, such as a cutting blade or a die, a means for moving the cutting instrument into cutting engagement with the piled or fleecy worksheets, a means for applying an electric charge to the pattern pieces and a means for removing the disconnected pile fibers from the pattern pieces. According to one embodiment of the invention, the electric charge is applied to the pattern pieces by an electric field while the worksheets lie on a cutting table, and the disconnected pile fibers are subsequently removed from the pattern pieces by a machine which agitates and vacuums the pattern pieces and which also may remove its electrical charge.

DETAILED DESCRIPTION OF THE PREFERRED EMBODIMENTS

Figure 1:
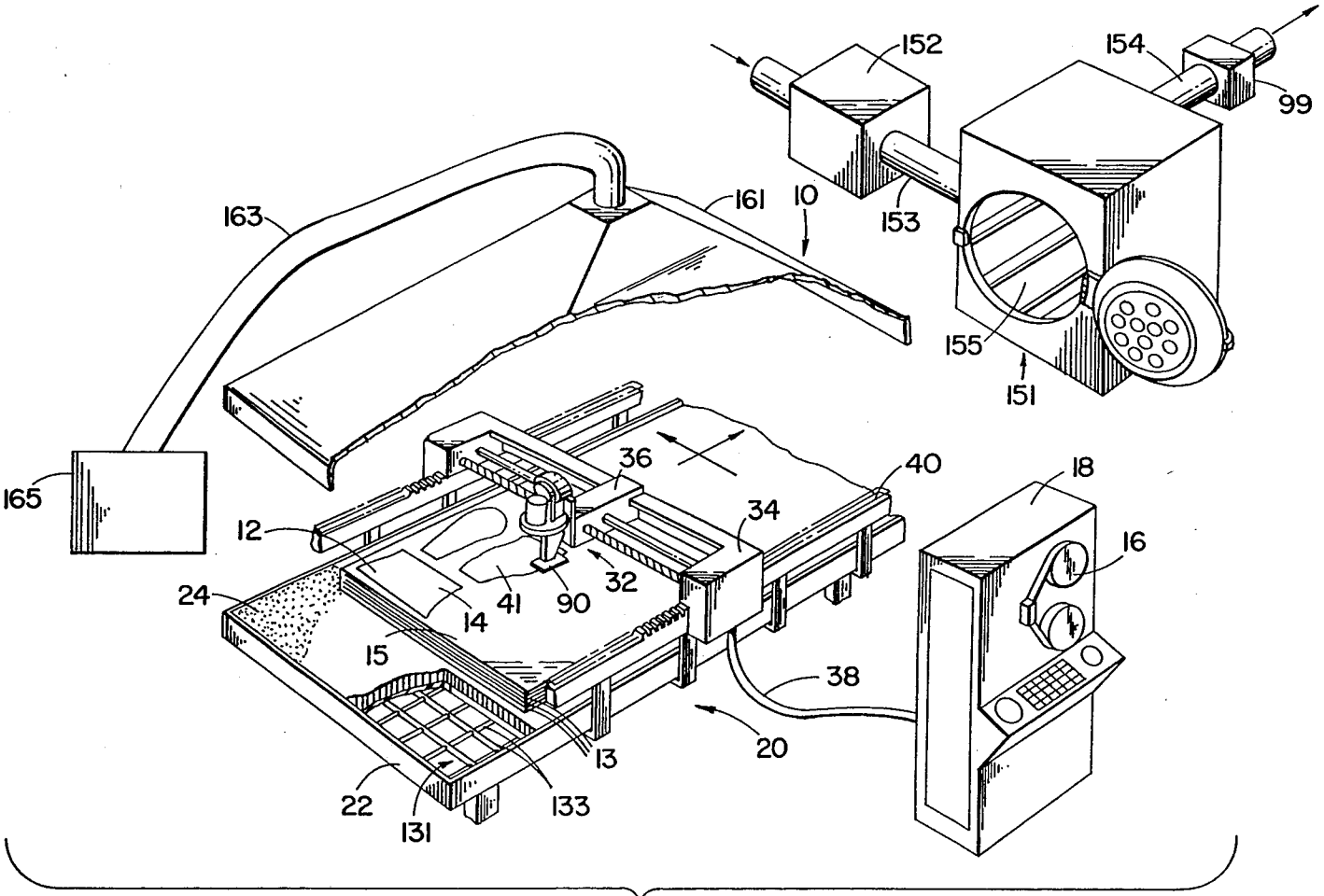
FIG. 1 is a perspective view of an automatic cutting and dedusting apparatus embodying the present invention, parts of which apparatus are broken away to reveal interior parts.

FIG. 1 shows a numerically controlled cutting and dedusting apparatus generally designated 10 embodying the present invention. The apparatus 10 first works by means of a cutting machine 20 on a stack or layup 12 of worksheets 13, 13 to cut out bundles of pattern pieces 14 in response to digitized information on a program tape 16. The tape 16 is read by a computerized controller 18 which, among other things, converts the information into motor commands transmitted to the cutting machine 20. The machine has a table comprising a frame 22 containing a penetrable bed 24 having a support surface on which the sheet material is spread to form the layup 12. The bed 24 my be constructed of blocks of foamed plastic or as shown in FIGS. 1, 3, 6, 7 and 8 of bristled mats which easily may be penetrated by a cutting instrument which plunges through the layup from above. A vacuum holddown system, such as that disclosed in U.S. Pat. No. 3,495,492 referenced above, may be utilized to hold the layup in position on the table during a cutting operation, such system including a plastic overlay 15 and a source of vacuum which draws the overlay 15 towards the support surface to compress the layup 12.

In the cutting machine 20, the cutting instrument takes the form of a reciprocating knife blade 30 (shown in FIG. 2) which is part of a cutting head 32 and is suspended in cantilevered fashion at its upper end. The cutting head rotates under the influence of a controlled drive motor (not shown) about a $\theta$ axis (FIG. 2) coincident with the leading, cutting edge of the blade, and the blade is slidably supported in a guide slot 75 (shown in FIG. 3) in a block 70 forming part of the cutting head. The cutting head 32 is in turn supported above the bed 24 by a Y-carriage 36 and an X-carriage 34 which are translatable by conventional means over the bed in the illustrated Y-direction and X-direction, respectively.

Figure 2:
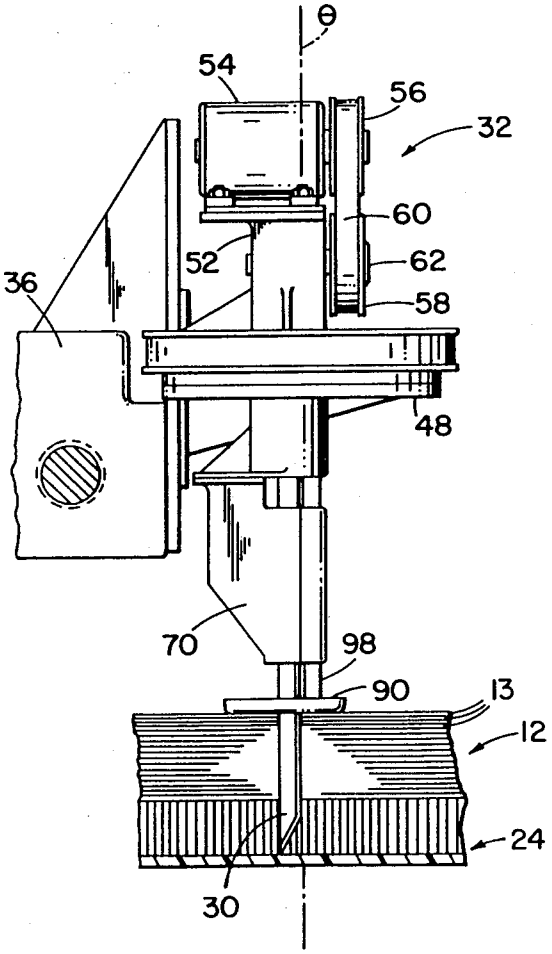
FIG. 2 is a plan view of a cutting head of the cutting apparatus of FIG. 1.
Figure 3:
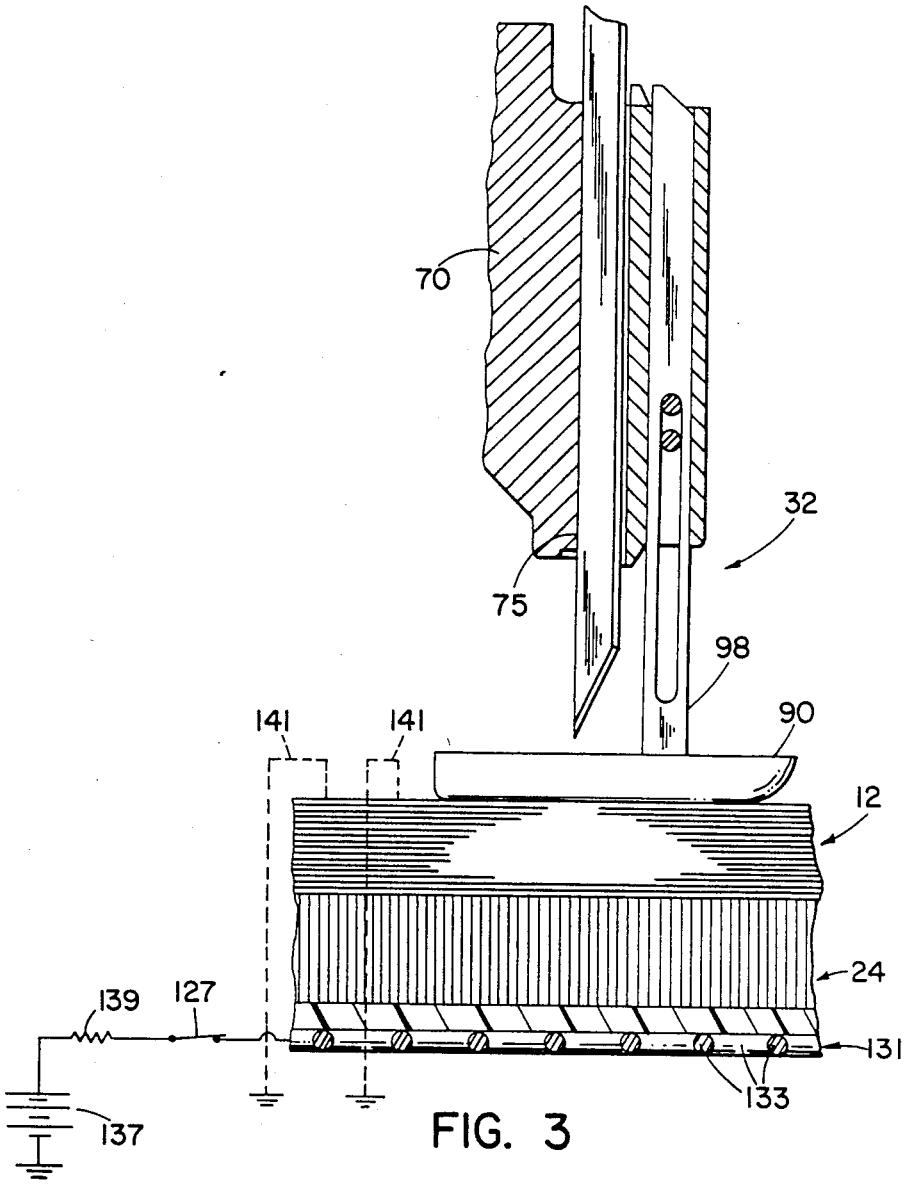
FIG. 3 is a cross-sectional, fragmentary plan view of the cutting and dedusting apparatus of FIG. 1, including a cutting blade shown in a retracted position and a cutting table.

As shown most clearly in FIG. 2, the cutting head 32 is mounted on an elevating platform 48 at the projecting end of the X-carriage 36. The platform 48 is moved vertically between the upper and lower limits relative to the carriage 36 by a motor (not shown) controlled by the controller 18. The platform 48 is illustrated at its lower limit in FIG. 2 and in this position the reciprocating blade at the lower end of its stroke pierces through the layup 12 and into the penetrable bed 24. As shown in FIG. 3, when the platform 48 is at the upper limit of its movement relative to the carriage 36, the blade is supported above and entirely disengaged from the layup.

Mounted on a pedestal 52 at the upper portion of the cutting head is a motor 54 connected to the reciprocating blade 30 by means of drive pulleys 56 and 58 and drive belt 60. The pulley 58 is mounted on the end of and drives a shaft 62 which forms part of a crank or eccentric mechanism for reciprocating the blade 30 when the motor 54 is operating.

With the supporting and driving mechanisms described above, the blade 30 may be plunged through the layup 12 at any point on the bed 24, can be moved along any desired line of cut relative to the layup 12, and can be rotated into a position tangent to the line of cut at each point along such line to cut a plurality of pattern piece bundles.

As shown in FIGS. 2 and 3, a presser foot 90, comprised generally of a hard plastic pressure plate 94 is fixedly secured by a screw 96 to the lower end of a hard plastic support rod 98 depending vertically from the guide block 70. The plate 94 has a central cutout 95 accommodating the blade 30. The support rod 98 is supported to slide vertically within a channel in the guide block 70 in a direction parallel to the reciprocation of the blade 30 by means of a pair of dowels 102 fixed to the block and extending through a slot 100 in the rod. The slot 100 and dowels 102 allow the lower pressing surface of the pressure plate 94, if desired, to rest on the top of the layup 12 under the weight of the foot 90 to help compress the layup in the vicinity of the blade 30. When the cutting head moves in the X-Y plane, the presser foot moves along the surface of the layup.

Figure 4:
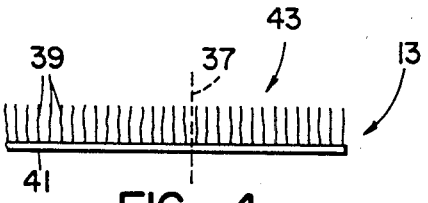
FIG. 4 is an enlarged, fragmentary side view of a single worksheet of a piled or fleecy material which may be cut by the cutting apparatus of FIG. 1.

FIG. 4 shows a single worksheet 13 of the layup 12 as the worksheet 13 exists apart from the layup and free of any external interference or forces. This worksheet 13 comprises a pile made of pile fibers 39, 39 and a carrier sheet 41 to which the pile fibers 39, 39 are attached at one end. The pile fibers 39, 39 and the carrier sheet 41 may be made of a variety of dielectric materials such as thermoplastic, cotton, wool or leather. As a common example each worksheet may be a velour fabric in which the pile fibers and the carrier sheet are made of polyester fibers.

Figure 5:
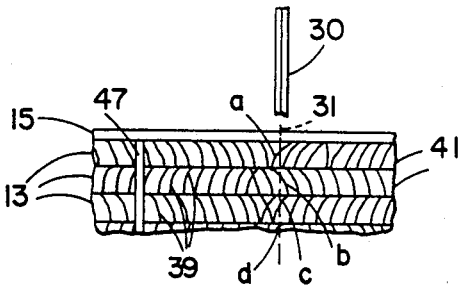
FIG. 5 is an enlarged fragmentary side view of a layup of a number of piled or fleecey worksheets such as those of FIG. 4, which layup may be cut by the cutting apparatus of FIG. 1.

The pile fibers 39, 39 are usually on the order of one-thirty-second inch to one-eighth inch long and are each free at their end opposite the carrier sheet. In the unstressed condition shown in FIG. 4, the pile fibers extend upwardly from the carrier sheet 41 generally parallel to one another to collectively form a pile or fleece 43. With the pile fibers extending substantially vertically, a blade may cut along a line of cut or penetration 37, shown in broken lines in FIG. 4, and avoid cutting many of the pile fibers adjacent the line of cut. However, for cutting purposes a worksheet 13 is often stacked with other similar worksheets 13, 13 (and such worksheets may sometimes be tied together by one or more fasteners 47 such as stiches or staples) to form the layup 12, as shown in FIG. 5, with a plastic sheet 15 placed over the layup and a vacuum applied underneath the layup. FIG. 5 further shows the cutting blade 30 as it penetrates into the layup 12 along a line 31 during cutting. Due to the compression of the layup 12, the pile fibers 39, 39 of each worksheet are bent downwardly toward the associated carrier sheet 41 so that when the blade cuts the layup, as along the line 31, portions of some of the pile fibers 39, 39, indicated at A, B, C and D are cut and thereby disconnected from the remainder of the worksheets 13, 13, either from the pattern pieces or from the scrap portions, because some pile fibers cross the blade line 31.

Focussing now on the present invention, as illustrated in FIGS. 1 and 3, wires 133 are located adjacent the bed 24, which wires are insulated and form an electrically conductive grid 131. At a time while the layup 12 is on the cutting table, either shortly before the layup is cut, while it is being cut, or after it has been cut, or during a combination of such times, a high voltage relative to ground is applied to the wire grid 131. As illustrated in FIG. 3, the voltage establishes an external electric field, indicated by electric field lines 141, 141, between the wire grid and ground, and the field induces a static electrical charge on the layup and the overlay. The timing of the occurrence of the electric field is such that the pattern pieces 14 and possibly overlying cut portions 41 of the overlay 15 will retain a residual static charge when they are later removed from the cutting table and lasting until they are dedusted in the manner discussed below. As shown schematically in FIG. 6, the voltage is applied by a DC power source 137 via a large resistor 139, a switch 127 and a wire 140. The large resistor 139 is included by safety purposes because it will limit the current to the grid 131 in the event the grid is somehow inadvertently shorted to ground. Besides establishing the electric field, the grid also supports the bed 24.

As the blade 30 cuts one or more bundles of pattern pieces, it cuts some of the pile fibers such as those indicated as A, B, C or D. Some of the cut pile fiber portions are moved upwardly through the layup by the reciprocation of the blade, however the plastic overlay 15 and the vacuum, if used, trap many of the cut pile fiber portions and prevent them from escaping from the layup 12 as dust. If the voltage is applied to the wire grid 131 shortly before or during cutting, the resultant charge on the material will also trap the loose cut pile fibers portions, and such form of operation may be particularly advantageous in cases where a vacuum holddown is not used. Also, if desired, a vacuum hood 161 located along the table and coupled by a vacuum hose 163 to a vacuum pump 165 may be used to capture cut pile fiber portions which escape from the layup 12 during cutting.

After the layup 12 is cut into pattern pieces, and if not already done before the cutting, each stack of pattern pieces is preferably, although not necessarily, tied together as a bundle by one or more fasteners in the form of stitches or staples. Then the bundles of pattern pieces and scrap are separated from one another and removed from the cutting table, the bundles being carried towards a dedusting machine 151 and the scrap being taken to a waste receptacle or station (not shown). In this transport step, the pattern pieces and scrap are unavoidably agitated to some degree. However, the static charge on the pattern pieces and scrap traps the cut, disconnected pile fiber portions by causing them to be attracted to and held by the pattern pieces or scrap by "static cling", and prevents them from escaping into the work environment as dust from the pattern pieces and scrap.

Usually, the scrap is dumped directly into a waste receptacle or the like without significant additional handling and in such cases the scrap generally need not be dedusted. However, if the scrap has a use requiring some amount of further handling, it may be dedusted, if desired, as are the bundles of pattern pieces by the dedusting machine 151, as hereinafter described.

The illustrated machine 151 is a batch processing one resembling a clothes dryer and includes a drum 155 which receives and tumbles the bundles of pattern pieces (or scrap if desired). While inside the drum, the pattern pieces are subjected to a flow of air which moves into and out of the drum and which in the course of such flow picks up and takes with it loose fibers shaken free of the pattern pieces by the tumbling. This flow of air may be created either by a positive pressure blower blowing air into the drum or by a negative pressure blower or vacuum source withdrawing air from the drum. As shown in FIG. 1, the machine 151 is shown by way of example as using a positive pressure blower 152 with the air from the blower moving into the drum 155 through a pipe 153 and out of the drum through a pipe 154. The freed cut pile fibers moving out of the drum with the air flow are preferably trapped either by a filter 99 in the exhaust pipe 154 of by a separate centrifugal or "cyclone" separator.

To facilitate the air flow removal of the cut pile fibers, the electrostatic charge on the pattern pieces is preferably dissipated while the pieces are in the machine 151, for example by placing in the drum one or more sheets of static charge dissipating material (such as those sold commercially for clothes dryers), by spraying a static dissipating spray into the drum or by subjecting the material in the drum to ozone or ultraviolet light. After the bundles have been dedusted, they are removed from the dedusting machine 151 and transported to a subsequent work station or elsewhere.

In a continuous processing system the illustrated machine 151 may be replaced by one having a drum open on both ends and containing helical flights or the like for conveying material introduced at one end to the other end as the drum rotates, with the dedusting, including air flow, occurring as the material passes through the drum. In any event, in the dedusting step most of the cut fibers are removed so that bundles may thereafter be taken apart (if not already done) and the pattern pieces handled without creating a dust problem.

Figure 7:
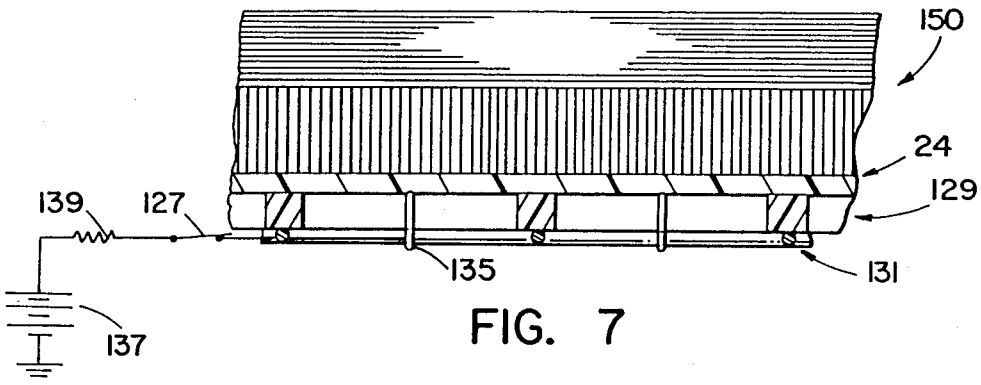
FIG. 7 is a fragmentary side view of FIG. 6.
Figure 6:
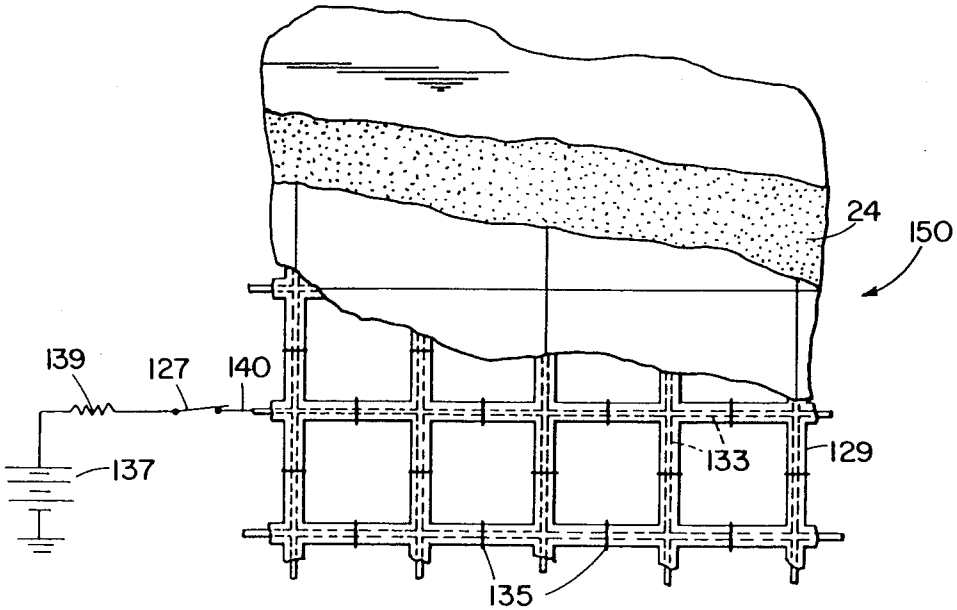
FIG. 6 is a fragmentary, top view of a cutting table of another embodiment of the invention.

FIGS. 6 and 7 illustrate cutting table portions of another cutting and dedusting apparatus 150 embodying the invention, which apparatus is identical to the apparatus 10 except that in the apparatus 150, the penetrable bed 24 is supported on a plastic grid 129, and the wire grid 129 is attached to the plastic grid by bands 135, 135.

Figure 8:
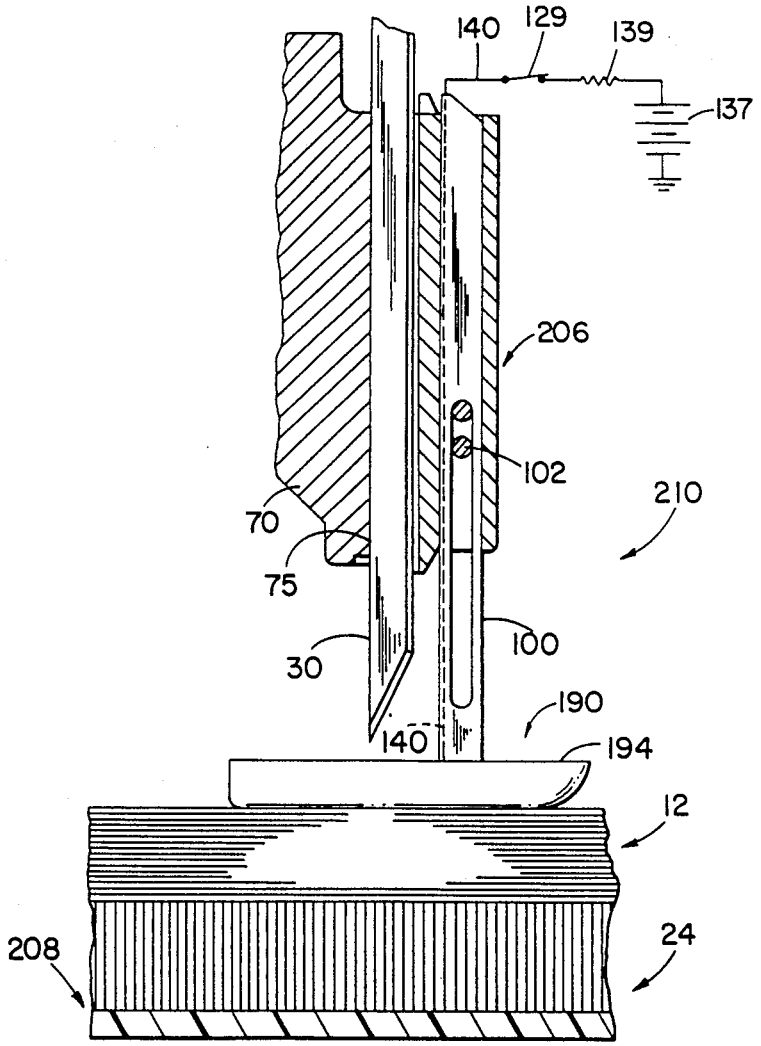
FIG. 8 is a fragmentary, cross-sectional view of another automatic cutting and dedusting apparatus embodying the invention.

FIG. 8 illustrates a cutting head 206 and a cutting table 208 of another cutting and dedusting apparatus generally designated 210 embodying the invention. The apparatus 210 and the cutting and dedusting processes carried out with it are identical to the apparatus 10 and the associated cutting and dedusting process except in the apparatus 210, the wire grid 131 is omitted, a presser foot 190 including a metal pressure plate 194 substitutes for the presser foot 90 with its hard plastic pressure plate 94 and the wire 140 directly connects the switch 129 to the pressure plate 194 to apply voltage to the pressure plate when desired. In addition to the safety provided by the resistor 139, the pressure plate 194 may be encased in an insulating sheath. While the worksheets lie on the cutting table, the voltage from the power source 137 is applied to pressure plate 194 shortly before, during or after the cutting operation or during a combination of such times. The voltage on the pressure plate establishes an electric field which emanates downwardly, which field develops a static electric charge on the layup 12. The static electric charge developed by the apparatus 210 traps cut, disconnected pile fibers, by the occurrence of so-called "static cling" and prevents them from escaping the bundles of pattern pieces and scrap as dust when the bundles and scrap are transported elsewhere as discussed above. If desired, the cutting and dedusting apparatus 210 may be outfitted with a wire grid, such as the wire grid 131, beneath the penetrable bed 24 and the wire grid grounded to concentrate the electric field produced by the metal pressure plate 194 on the layup.

By the foregoing, automatic cutting and dedusting apparatuses embodying the present invention have been disclosed. However, numerous modifications and substitutions may be made without deviating from the spirit of the invention. For example, the insulating sheath may be removed from the pressure plate 194 in any arrangement of the apparatus 210 disclosed above to increase the static charge on the layup 12. Also, in any of the embodiments of the cutting and dedusting apparatuses described above, the dedusting machine 151 may be replaced by another type of dedusting machine which utilizes the same or other means for dissipating the static charge, for agitating bundles of pattern pieces and for vacuuming the bundles, i.e., withdrawing air from the space containing the bundles to remove with such withdrawn air the loose fibers loosened from the bundles by their agitation and by the release of the static charge. Also, electrostatic charges can be created by other means.

Therefore, the invention has been disclosed by way of illustration and not by limitation.

I claim:

1. An automatic cutting and dedusting apparatus for cuting a pattern piece from a worksheet and thereafter removing free cut fibers, said apparatus comprising:

means for cutting a worksheet at a cutting station to produce a pattern piece, means for statically charging said pattern piece at said cutting station so that when said pattern piece is thereafter removed from said cutting station free cut fibers will tend to adhere to said pattern piece as a result of its static charge, and dedusting means remote from said cutting station including means creating a flow of air past said pattern pieces for separating the free cut fibers from said pattern piece.

2. An automatic cutting and dedusting apparatus as set forth in claim 1 further comprising means for agitating said pattern piece while said flow of air moves past said pattern pieces.

3. An automatic cutting and dedusting apparatus as set forth in claim 1 further characterized by means cooperating with said means for creating an air flow for dissipating the static charge on said pattern piece.

4. A cutting and dedusting apparatus as set forth in claim 1 wherein said worksheet comprises a piled material and further comprising a plurality of piled worksheets stacked with the first said worksheet as a layup, and means for compressing said layup.

5. A cutting and dedusting apparatus as set forth in claim 4 wherein the piled fibers of said worksheets are made of thermoplastic material.

6. An automatic cutting and dedusting apparatus as set forth in claim 1 wherein said means for producing a static charge on said pattern piece comprises means for producing an electric field which acts upon said pattern piece.

7. A cutting and dedusting apparatus as set forth in claim 6 wherein said cutting station includes a cutting surface which supports said worksheet and said electric field producing means includes a first electrical conductor located near said cutting surface and means for applying a voltage to said electrical conductor.

8. A cutting and dedusting apparatus as set forth in claim 7 wherein said electrical conductor includes a plurality of wires electrically connected to one another.

9. A cutting and dedusting apparatus as set forth in claim 8 further comprising a plurality of worksheets stacked with the first said worksheet as a layup, a second electrical conductor, said first and second electrical conductors located on opposite side of said layup, and said second electrical conductor being grounded.

10. A method for cutting a pattern piece from a worksheet and dedusting said pattern piece, said method comprising the steps of:

cutting said pattern piece from said worksheet at one site, electrically charging said pattern piece at said one site, transporting said pattern piece to a second site while said pattern piece remains at least partially charged, moving air adjacent said pattern piece at said second site to separate free cut fiber portions from it.

11. The method set forth in claim 10 further comprising the step of agitating said pattern piece at said second site.

12. The method set forth in claim 11 wherein the step of electrically charging said pattern piece comprises the step of subjecting said pattern piece to an electrical field.

13. The method set forth in claim 11 wherein the step of moving air past said pattern piece occurs simultaneously with the step of agitating said pattern piece.

14. The method set forth in claim 11 further comprising the step of stacking additional worksheets with the first said worksheet to form a layup and wherein said additional worksheets are cut approximately simultaneously with the cutting of the first said worksheet.

15. The method set forth in claim 14 further comprising the step of compressing said layup for cutting.

16. The method set forth in claim 11 further comprising the step of electrically discharging said pattern piece while air is moved adjacent said pattern piece.

17. The method set forth in claim 16 where the step of electrically discharging said pattern piece comprises the step of exposing said pattern piece to a static dissipation sheet.

18. The method set forth in claim 16 wherein the step of electrically discharging said pattern comprises the step of exposing said pattern piece to ozone.

19. The method set forth in claim 16 wherein the step of electrically discharging said pattern piece comprises the step of exposing pattern piece to ultraviolet light.

20. An automatic cutting and dedusting apparatus for cutting a pattern piece from a worksheet and thereafter removing free cut fibers, said apparatus comprising:

means for cutting a worksheet at a cutting station to produce a pattern piece, means for statically charging said pattern piece at said cutting station so that when said pattern piece is thereafter removed from said cutting station free cut fibers will tend to adhere to said pattern piece as a result of its static charge, and dedusting means for separating said free cut fibers from said pattern piece and from the work environment.

21. An automatic cutting and dedusting apparatus as set forth in claim 20 wherein said dedusting means comprises:

means for simultaneously agitating said pattern piece and moving air adjacent said pattern piece.

22. An automatic cutting and dedusting apparatus for cutting pattern pieces from a layup of worksheets and removing fiber portions which are cut and thereby disconnected from said worksheets said apparatus comprising:

a cutting surface for supporting said layup, an overlay for said layup, a cutting instrument for cutting said pattern pieces and an overlaying portion of said overlay, means for moving said cutting instrument into cutting engagement with said overlay and said layup, means for statically charging said cut portion of said overlay so that when said pattern pieces and overlay portion are transported from said cutting surface the charge on said overlay portion traps disconnected fiber portions and prevents them from escaping as dust, and means for agitating said pattern pieces and for trapping disconnected fiber portions which are agitated free of said pattern pieces to keep many of said disconnected fiber portions out of the work environment.

23. An automatic cutting and dedusting apparatus as set forth in claim 22 wherein said agitating and trapping means includes means for creating a flow of air past said pattern pieces which flow of air picks up said disconnected fiber portions and carries them away from said pattern pieces.

24. An automatic cutting and dedusting apparatus as set forth in claim 23 further comprising means cooperating with said agitating and trapping means for dissipating the static charge on said pattern piece.

25. The apparatus set forth in claim 22 wherein said means for statically charging also statically charges said pattern pieces underlying said overlay portion.

* * * * *